US011293680B2

(12) United States Patent
Scalf

(10) Patent No.: US 11,293,680 B2
(45) Date of Patent: Apr. 5, 2022

(54) REFRIGERATOR WITH MULTIPLE ICE MOVERS

(71) Applicant: Midea Group Co., Ltd., Foshan (CN)

(72) Inventor: Eric Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 16/441,791

(22) Filed: Jun. 14, 2019

(65) Prior Publication Data

US 2020/0393185 A1 Dec. 17, 2020

(51) Int. Cl.

| | |
|---|---|
| ***F25C 5/20*** | (2018.01) |
| ***F25D 23/12*** | (2006.01) |
| ***F25C 5/182*** | (2018.01) |
| ***F25C 5/04*** | (2006.01) |
| ***F25D 29/00*** | (2006.01) |

(52) U.S. Cl.

CPC ..... *F25C 5/22* (2018.01); *F25C 5/046* (2013.01); *F25C 5/182* (2013.01); *F25D 23/12* (2013.01); *F25D 29/00* (2013.01); *F25C 2400/10* (2013.01)

(58) Field of Classification Search

CPC .. F25C 5/22; F25C 5/182; F25C 5/046; F25C 2400/10; F25C 2500/08; F25D 23/12; F25D 29/00

See application file for complete search history.

(56) References Cited

U.S. PATENT DOCUMENTS

| | | | | |
|---|---|---|---|---|
| 1,868,763 | A | 7/1932 | Raymond | |
| 2,369,539 | A * | 2/1945 | Delamere | F01C 20/185 418/203 |
| 2,504,622 | A | 4/1950 | Band | |
| 2,869,714 | A | 1/1959 | Williams | |
| 2,914,218 | A | 11/1959 | Korodi | |
| 3,146,601 | A | 9/1964 | Gould | |
| 3,187,958 | A | 6/1965 | Swart | |
| 3,218,111 | A | 11/1965 | Steiner | |
| 3,351,233 | A | 11/1967 | Chanoch et al. | |
| 3,485,058 | A | 12/1969 | Nagel | |
| 3,549,000 | A * | 12/1970 | Christian | B65G 33/00 198/659 |
| 3,580,389 | A * | 5/1971 | Nonnenmacher | B29C 48/252 198/625 |

(Continued)

FOREIGN PATENT DOCUMENTS

| | | | |
|---|---|---|---|
| CN | 1648561 | A | 8/2005 |
| CN | 1690621 | A | 11/2005 |

(Continued)

OTHER PUBLICATIONS

U.S. Patent and Trademark Office, Notice of Allowance issued in U.S. Appl. No. 15/836,035 dated Oct. 5, 2020.

(Continued)

*Primary Examiner* — Ljiljana V. Ciric

(74) *Attorney, Agent, or Firm* — Middleton Reutlinger

(57) ABSTRACT

A refrigerator utilizes an ice dispensing system incorporating first and second ice movers and a controller that operates the first ice mover to move ice toward the first end of a storage bin and out of a dispenser outlet during an ice dispensing operation, and operates the second ice mover concurrently with operating the first ice mover to circulate ice in the storage bin during an ice circulation operation.

14 Claims, 3 Drawing Sheets

(56) References Cited

U.S. PATENT DOCUMENTS 3,602,007 A 8/1971 Drieci
3,640,433 A 2/1972 Rodth
3,643,464 A 2/1972 Hilliker et al.
3,744,270 A 7/1973 Wilcox
3,777,000 A 12/1973 Ernst et al.
3,785,512 A 1/1974 Gatz et al.
3,798,923 A 3/1974 Pink et al.
3,809,295 A 5/1974 Vitencz
3,858,765 A 1/1975 Landers
3,874,559 A * 4/1975 Pink ..... F25C 5/22 222/146.6
3,911,692 A 10/1975 Maxwell et al.
4,078,653 A * 3/1978 Suter ..... F01C 21/102 198/625
4,084,725 A 4/1978 Buchser
4,104,889 A 8/1978 Hoenish
4,129,015 A 12/1978 Morris, Jr.
4,168,805 A 9/1979 Taylor
4,176,527 A * 12/1979 Linstromberg ..... F25C 5/046 222/240
4,184,625 A 1/1980 Stollberg et al.
4,189,063 A 2/1980 Matthiesen
4,227,383 A 10/1980 Horway
4,285,212 A 8/1981 Prada
4,306,757 A 12/1981 Horway et al.
4,333,612 A 6/1982 Hayashi
4,420,948 A 12/1983 Savage
4,790,146 A 12/1988 Mun et al.
4,804,111 A 2/1989 Ricciardi et al.
4,869,076 A 9/1989 Sakai et al.
4,942,983 A 7/1990 Bradbury
4,969,583 A 11/1990 Torimitsu et al.
4,972,999 A * 11/1990 Grace ..... F25C 5/046 241/101.1
5,050,777 A * 9/1991 Buchser ..... A23G 9/045 222/146.6
5,056,688 A 10/1991 Goetz et al.
5,149,551 A 9/1992 Anderson
5,219,103 A 6/1993 Carper
5,299,427 A 4/1994 Miller
5,560,221 A 10/1996 Snelling et al.
5,947,342 A * 9/1999 Song ..... F25C 5/046 222/413
6,010,037 A * 1/2000 Thompson ..... F25C 5/24 222/413
6,019,447 A 2/2000 Jackovin
6,438,976 B2 * 8/2002 Shapiro ..... F25C 1/125 62/344
6,442,954 B1 9/2002 Shapiro et al.
6,574,984 B1 6/2003 McCrea et al.
6,860,408 B2 3/2005 Hawkes
6,904,765 B2 6/2005 Lee et al.
7,137,582 B1 11/2006 Mikkelsen et al.
7,188,479 B2 3/2007 Anselmino et al.
7,228,702 B2 6/2007 Maglinger et al.
7,284,390 B2 10/2007 Van Meter et al.
7,318,633 B2 1/2008 Shin et al.
7,337,620 B2 3/2008 Coulter et al.
7,343,757 B2 3/2008 Egan et al.
7,386,992 B2 6/2008 Adamski et al.
7,455,085 B2 11/2008 Voglewede et al.
7,475,562 B2 1/2009 Jackovin
7,493,774 B2 2/2009 Ferragut, II et al.
7,591,399 B2 9/2009 Hortin et al.
7,658,212 B2 2/2010 Meuleners et al.
7,673,471 B2 3/2010 Egan et al.
7,707,847 B2 5/2010 Davis et al.
7,712,321 B2 5/2010 Kadyk
7,762,097 B2 * 7/2010 Jeong ..... F25C 5/22 62/343
7,836,719 B2 * 11/2010 Jeong ..... F25C 5/046 241/190
7,997,452 B2 8/2011 Kim et al.
8,001,796 B2 8/2011 Kim et al.
8,006,502 B2 8/2011 Kim et al.
8,191,378 B2 6/2012 Park
8,191,379 B2 6/2012 Wuesthoff et al.
8,196,618 B2 6/2012 Kim et al.
8,201,715 B2 6/2012 Park et al.
8,240,519 B2 * 8/2012 Buchstab ..... F25C 5/22 62/320
8,312,735 B2 11/2012 Fulton
8,336,330 B2 12/2012 Lee et al.
8,353,177 B2 1/2013 Adamski et al.
8,454,103 B2 6/2013 Jeon et al.
8,459,055 B2 * 6/2013 Kim ..... F25C 5/24 62/320
8,499,577 B2 8/2013 Watson et al.
8,516,845 B2 8/2013 Wuesthoff et al.
8,596,085 B2 12/2013 Koo et al.
8,616,019 B2 12/2013 Van Meter et al.
8,656,731 B2 2/2014 Kim
8,671,708 B2 3/2014 Jeong
8,701,428 B2 4/2014 Lee et al.
8,701,436 B2 4/2014 Kim
8,707,726 B2 4/2014 Lim et al.
8,733,123 B2 5/2014 Adamski et al.
8,746,002 B2 * 6/2014 Lee ..... F25C 5/22 62/320
8,756,952 B2 6/2014 Adamski et al.
8,806,884 B2 * 8/2014 Park ..... F25D 25/025 62/344
8,925,340 B2 * 1/2015 Chung ..... F25C 5/046 62/320
9,068,772 B2 6/2015 Yeo et al.
9,085,453 B2 7/2015 McMahan et al.
9,284,179 B2 3/2016 Clancy et al.
9,415,945 B1 * 8/2016 Whitney ..... B65G 33/265
9,476,631 B2 10/2016 Park et al.
9,593,875 B2 3/2017 Van Meter et al.
9,683,771 B2 6/2017 Anselmino et al.
9,791,198 B2 10/2017 Jeong et al.
RE46,794 E * 4/2018 Lee ..... F25C 5/22
10,119,747 B2 11/2018 You et al.
10,139,147 B2 * 11/2018 Kang ..... F25C 5/02
10,208,997 B2 * 2/2019 Visin ..... F25C 5/22
RE48,303 E * 11/2020 Lee ..... F25C 5/22
11,131,492 B2 * 9/2021 Scalf ..... F25C 5/04
11,137,189 B1 * 10/2021 Reuter ..... F25C 5/22
11,181,309 B2 * 11/2021 Shi ..... F25C 5/182
2004/0007009 A1 1/2004 Wing et al.
2005/0132739 A1 6/2005 Sannasi et al.
2005/0178273 A1 8/2005 Meuleners et al.
2005/0268638 A1 12/2005 Voglewede et al.
2006/0016205 A1 * 1/2006 Tremblay ..... F25C 1/04 62/340
2006/0059939 A1 3/2006 An et al.
2006/0065008 A1 3/2006 Park
2006/0086132 A1 4/2006 Maglinger et al.
2006/0090496 A1 5/2006 Adamski et al.
2006/0162369 A1 7/2006 Chae
2006/0272347 A1 12/2006 Park
2007/0033960 A1 2/2007 Egan et al.
2007/0113578 A1 5/2007 Wu et al.
2007/0204643 A1 9/2007 Harris
2008/0174220 A1 7/2008 Kim et al.
2008/0272679 A1 11/2008 Wuesthoff et al.
2008/0314065 A1 12/2008 Kim
2009/0008403 A1 1/2009 Lee et al.
2009/0009042 A1 1/2009 Kim et al.
2009/0031751 A1 2/2009 Ayvazoglu
2009/0229284 A1 9/2009 Fulton et al.
2010/0037631 A1 2/2010 Choi et al.
2010/0050681 A1 3/2010 Ryu et al.
2010/0066224 A1 3/2010 Placke et al.
2010/0082159 A1 4/2010 Kim et al.
2010/0293984 A1 11/2010 Adamski et al.
2011/0041542 A1 * 2/2011 Brunner ..... F25C 5/22 62/344
2011/0126576 A1 6/2011 Jeong
2011/0138821 A1 6/2011 Chase et al.
2011/0167862 A1 7/2011 Shin et al.
2011/0174008 A1 7/2011 Kim

(56) References Cited

U.S. PATENT DOCUMENTS

| | | | | |
|---|---|---|---|---|
| 2011/0239687 | A1 | 10/2011 | Lim et al. | |
| 2012/0031136 | A1* | 2/2012 | Park | F25D 25/025 62/340 |
| 2012/0036882 | A1 | 2/2012 | Park et al. | |
| 2012/0103002 | A1 | 5/2012 | Lee et al. | |
| 2013/0142457 | A1 | 6/2013 | Jährling et al. | |
| 2013/0263620 | A1 | 10/2013 | An et al. | |
| 2013/0263621 | A1 | 10/2013 | An et al. | |
| 2014/0000303 | A1 | 1/2014 | Jeong et al. | |
| 2014/0000304 | A1* | 1/2014 | Kim | F25C 5/24 62/344 |
| 2014/0182323 | A1* | 7/2014 | Brunner | F25C 5/182 62/344 |
| 2014/0251498 | A1 | 9/2014 | Park et al. | |
| 2014/0252938 | A1 | 9/2014 | Kim et al. | |
| 2014/0285082 | A1 | 9/2014 | Choi et al. | |
| 2016/0003294 | A1 | 1/2016 | Lindinger | |
| 2016/0084560 | A1 | 3/2016 | Jeong et al. | |
| 2016/0265816 | A1 | 9/2016 | Gillette et al. | |
| 2016/0341462 | A1 | 11/2016 | Kim | |
| 2016/0370102 | A1 | 12/2016 | Yang | |
| 2017/0082339 | A1 | 3/2017 | Adamski et al. | |
| 2017/0082340 | A1 | 3/2017 | Adamski et al. | |
| 2017/0138659 | A1 | 5/2017 | Lee et al. | |
| 2017/0167780 | A1 | 6/2017 | Jeong et al. | |
| 2017/0174493 | A1 | 6/2017 | Aranda et al. | |
| 2017/0292751 | A1 | 10/2017 | Lee et al. | |
| 2017/0314832 | A1 | 11/2017 | Kim | |
| 2018/0149408 | A1 | 5/2018 | Akca et al. | |
| 2019/0204001 | A1 | 7/2019 | Scalf | |
| 2021/0310714 | A1* | 10/2021 | Olvera | F25C 1/10 |

FOREIGN PATENT DOCUMENTS

| | | | |
|---|---|---|---|
| CN | 1811308 | A | 8/2006 |
| CN | 101650105 | A | 2/2010 |
| CN | 102575891 | A | 7/2012 |
| CN | 107314600 | A | 11/2017 |
| CN | 108931095 | A | 12/2018 |
| EP | 3695178 | | 8/2020 |
| JP | 2001153525 | A2 | 6/2001 |
| KR | 20060074931 | A | 7/2006 |
| KR | 201 00116767 | A | 11/2010 |
| KR | 101123710 | B1 | 3/2012 |
| KR | 20170055790 | A | 5/2017 |
| WO | 1997029330 | A1 | 8/1997 |
| WO | 2014086401 | A1 | 6/2014 |

OTHER PUBLICATIONS

International Search Report and Written Opinion issued is Application No. PCT/CN2019/094349 dated Sep. 25, 2019.
U.S. Patent and Trademark Office, Non-Final Office Action issued in related U.S. Appl. No. 15/836,035 dated Oct. 17, 2019. 20 Pages.
U.S. Patent and Trademark Office, Non-Final Office Action issued in U.S. Appl. No. 15/835,953 dated Feb. 26, 2020.
Korea Intellectual Property Office, Notification of Reason for Refusal issued in Application No. 10-2020-7012986, dated Mar. 29, 2021.
Australian Government IP, Examination Report No. 1 issued in Application No. 2018381656, dated Apr. 23, 2021.
U.S. Patent and Trademark Office, Office Action issued in U.S. Appl. No. 16/215,005 dated Jun. 23, 2020.
U.S. Patent and Trademark Office, Office Action issued in U.S. Appl. No. 15/835,953 dated Jun. 25, 2021.
Transmittal of Related Applications.
International Search Report and Written Opinion issued in Application No. PCT/CN2018/074188 dated Aug. 20, 2018.
International Search Report and Written Opinion issued in Application No. PCT/CN2018/074255 dated Aug. 29, 2018.
U.S. Patent and Trademark Office, Final Office Action issued in U.S. Appl. No. 15/836,035 dated May 14, 2020.
U.S. Patent and Trademark Office, Final Office Action issued in U.S. Appl. No. 16/297,082 dated May 17, 2021.
U.S. Patent and Trademark Office, Advisory Action issued in U.S. Appl. No. 15/836,035 dated Aug. 18, 2020.
U.S. Patent and Trademark Office, Office Action issued in U.S. Appl. No. 15/835,953 dated Sep. 4, 2020.
U.S. Patent and Trademark Office, Advisory Action issued in U.S. Appl. No. 15/835,953 dated Dec. 14, 2020.
U.S. Patent and Trademark Office, Notice of Allowance issued in U.S. Appl. No. 16/215,005 dated Oct. 15, 2020.
U.S. Patent and Trademark Office, Corrected Notice of Allowance issued in U.S. Appl. No. 15/836,035 dated Oct. 16, 2020.
U.S. Patent and Trademark Office, Office Action issued in U.S. Appl. No. 16/297,082 dated Oct. 21, 2020.
U.S. Patent and Trademark Office, Corrected Notice of Allowance issued in U.S. Appl. No. 16/215,005 dated Oct. 23, 2020.
Oswald, Kirstin U., U.S. Patent and Trademark Office, Office Action issued in U.S. Appl. No. 16/297,082 dated Jan. 6, 2022.

* cited by examiner

REFRIGERATOR WITH MULTIPLE ICE MOVERS

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Various refrigerator designs have been used, including, for example, top mount refrigerators, which include a freezer compartment near the top of the refrigerator, either accessible via a separate external door from the external door for the fresh food compartment, or accessible via an internal door within the fresh food compartment; side-by-side refrigerators, which orient the freezer and fresh food compartments next to one another and extending generally along most of the height of the refrigerator; and bottom mount refrigerators, which orient the freezer compartment below the fresh food compartment and including sliding and/or hinged doors to provide access to the freezer and fresh food compartments.

Irrespective of the refrigerator design employed, many refrigerator designs also include an ice dispensing system having an externally-accessible dispenser that is disposed at a convenient height on the front of the refrigerator, most often on the surface of one of the doors that provide access to one of the refrigerator compartments. The ice dispensing system also generally includes an ice maker capable of producing ice and depositing the produced ice into a storage bin for later on-demand dispensing by a consumer.

Conveying ice from a storage bin to a dispenser outlet such as an ice chute is generally performed using an ice mover such as a rotating auger that extends longitudinally through the storage bin and through rotation pushes ice forward towards the ice chute. An ice crusher may also be disposed proximate the ice chute to crush the ice prior to dispensing the ice.

It has been found, however, that many conventional ice dispensing systems are subject to ice clumping, e.g., as a result of ice in a storage bin melting and refreezing. Particularly when the doors of a refrigerator are opened and closed with some frequency, temperature and/or humidity variations may occur within the refrigerator and lead to clumping. Moreover, given the circular rotational profile of an ice auger, many storage bins are configured to be relatively tall and narrow, with the width of the storage bin generally sized to minimize the amount of space between the ice auger and its sidewalls, as otherwise ice could build up along the sidewalls and outside of the path of conveyance of the ice auger.

SUMMARY

The herein-described embodiments address these and other problems associated with the art by providing a refrigerator that utilizes an ice dispensing system incorporating multiple ice movers, e.g., multiple ice augers, that are arranged adjacent to one another and operable to move ice in opposite directions. Doing so may enable, for example, the multiple ice movers to be operated concurrently with one another to circulate ice in a storage bin and thereby break apart clumped ice.

Therefore, consistent with one aspect of the invention, a refrigerator may include a cabinet including one or more food compartments and one or more doors closing the one or more food compartments, an ice dispensing system disposed in the cabinet to produce ice, the ice dispensing system including a storage bin configured to store and dispense ice produced by the ice dispensing system, the storage bin including first and second ends, a dispenser outlet proximate the first end to dispense ice to an ice dispenser opening, and first and second ice movers arranged adjacent to one another between the first and second ends, where the first ice mover is operable to move ice toward the first end of the storage bin, and where the second ice mover is operable to move ice toward the second end of the storage bin, and a controller coupled to the ice dispensing system and configured to operate the first ice mover to move ice toward the first end of the storage bin and out of the dispenser outlet during an ice dispensing operation, and configured to operate the second ice mover concurrently with operating the first ice mover to circulate ice in the storage bin during an ice circulation operation.

In some embodiments, the first and second ice movers are oriented at a substantially same elevation. Also, in some embodiments, the first and second ice movers are augers. Further, in some embodiments, the second ice mover is further operable to move ice toward the first end of the storage bin, and the controller is configured to operate the second ice mover to move ice toward the first end of the storage bin concurrently with operating the first ice mover during the ice dispensing operation.

In some embodiments, the ice dispensing system includes first and second ice mover drives respectively coupled to the first and second ice movers. In addition, in some embodiments, the controller is configured to operate the second ice mover drive in a first direction to operate the second ice mover to move ice toward the first end of the storage bin, and to operate the ice mover drive in a second direction to operate the second ice mover to move ice toward the second end of the storage bin. In some embodiments, each of the first and second ice mover drives includes an electric motor. In addition, in some embodiments, the ice dispensing system includes an ice mover drive and a transmission, where at least one of the first and second ice movers is coupled to the ice mover drive through the transmission. Moreover, in some embodiments, the transmission is configured to selectively decouple the one of the first and second ice movers from the ice mover drive. In some embodiments, the transmission is configured to selectively reverse the one of the first and second ice movers. Moreover, in some embodiments, the ice mover drive includes an electric motor.

In some embodiments, the storage bin is a first storage bin, and the ice dispensing system further includes an ice maker disposed over the first storage bin and configured to produce ice and drop the ice into the first storage bin, and a second storage bin disposed below the first storage bin and configured to receive ice disposed in the first storage bin when the ice is moved toward the second end of the first storage bin. In addition, in some embodiments, the first storage bin includes an opening on a bottom wall thereof proximate the second end of the first storage bin, the opening positioned such that ice moved toward the second end of the first storage bin falls through the opening and into the second storage bin.

Consistent with another aspect of the invention, a refrigerator may include a cabinet including one or more food compartments and one or more doors closing the one or more food compartments, an ice dispensing system disposed in the cabinet to produce ice, the ice dispensing system including upper and lower storage bins configured to store and dispense ice produced by the ice dispensing system, the upper storage bin including first and second ends, a dispenser outlet proximate the first end to dispense ice to an ice dispenser opening, an opening proximate the second end to convey ice to the lower storage bin, first and second ice movers arranged adjacent to one another between the first and second ends, and first and second ice mover drives respectively coupled to the first and second ice movers, where the first ice mover drive is operable to drive the first ice mover to move ice toward the first end of the upper storage bin, and where the second ice mover drive is operable to drive the second ice mover to move ice toward the second end of the storage bin, and a controller coupled to the ice dispensing system and configured to operate the first ice mover drive to drive the first ice mover to move ice toward the first end of the storage bin and out of the dispenser outlet during an ice dispensing operation, configured to operate the second ice mover drive to drive the second ice mover to move ice toward the second end of the storage bin and through the opening during an ice transfer operation, and configured to operate the first and second ice movers concurrently with one another using the first and second ice mover drives to circulate ice in the upper storage bin during an ice circulation operation.

Consistent with another aspect of the invention, a method may be provided for operating a refrigerator ice dispensing system that includes a storage bin configured to store and dispense ice produced by the ice dispensing system and including first and second ends, a dispenser outlet proximate the first end to dispense ice to an ice dispenser opening, and first and second ice movers arranged adjacent to one another between the first and second ends. The method may include performing an ice dispensing operation by operating the first ice mover to move ice toward the first end of the storage bin and out of the dispenser outlet, and performing an ice circulation operation by operating the second ice mover concurrently with operating the first ice mover to circulate ice in the storage bin.

In some embodiments, the first and second ice movers are augers. Moreover, in some embodiments, performing the ice dispensing operation further includes operating the second ice mover to move ice toward the first end of the storage bin and out of the dispenser outlet. Also, in some embodiments, operating the first ice mover includes driving the first ice mover with a first ice mover drive, and operating the second ice mover includes driving the second ice mover with a second ice mover drive.

In some embodiments, the ice dispensing system includes an ice mover drive and a transmission, at least one of the first and second ice movers is coupled to the ice mover drive through the transmission, and performing at least one of the ice dispensing and ice circulation operations includes actuating the transmission to reverse or decouple from the ice mover drive at least one of the first and second ice movers. In addition, in some embodiments, the storage bin is a first storage bin, and the ice dispensing system further includes an ice maker disposed over the first storage bin and configured to produce ice and drop the ice into the first storage bin, and a second storage bin disposed below the first storage bin and configured to receive ice disposed in the first storage bin when the ice is moved toward the second end of the first storage bin, and the method further includes performing an ice transfer operation by operating the second ice mover to move ice toward the second end of the first storage bin.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
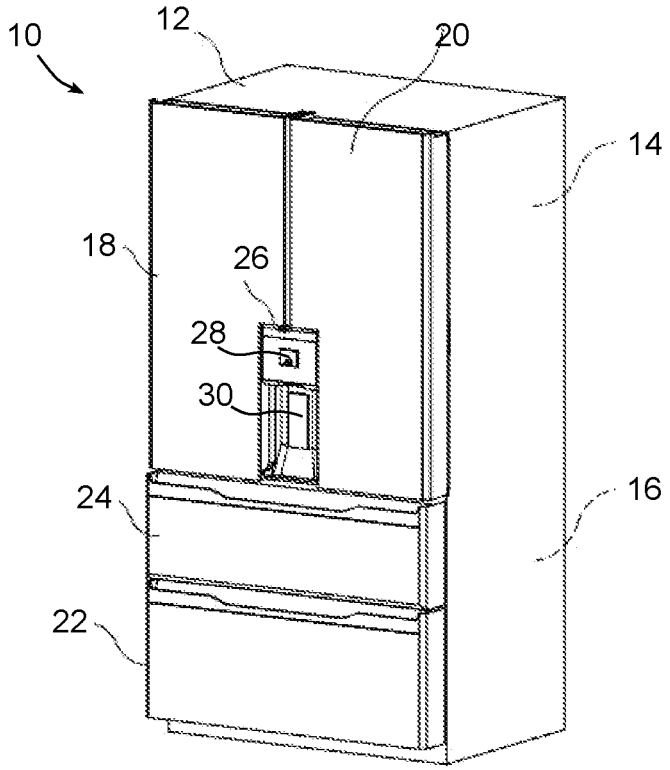
FIG. 1 Prior Art
FIG. 1 is a perspective view of an example implementation of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12 including one or more food storage compartments (e.g., a fresh food compartment 14 and a freezer compartment 16), as well as one or more fresh food compartment doors 18, 20 and one or more freezer compartment doors 22, 24 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, fresh food compartment doors 18, 20 are side-by-side fresh food compartment doors that are hinged along the left and right sides of the refrigerator to provide a wide opening for accessing the fresh food compartment. Freezer compartment doors 22, 24 are sliding freezer compartment doors that are similar to drawers and that pull out to provide access to items in the freezer compartment. Both the fresh food compartment and the freezer compartment may be considered to be full width as they extend substantially across the full width of the cabinet 12. It will be appreciated, however, that other door designs may be used in other embodiments, including various combinations and numbers of hinged and/or sliding doors for each of the fresh food and freezer compartments (e.g., a pair of French freezer doors, a single sliding freezer door, or one hinged fresh food and/or freezer door). Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments, e.g., top mount refrigerators, side-by-side refrigerators, etc.

Refrigerator 10 also includes a cabinet-mounted dispenser 26 for dispensing ice and/or water. Dispenser 26 may include one or more external user controls and/or displays, including, for example, a water dispenser control 28 and an ice dispenser control 30. In the illustrated embodiments, dispenser 26 is an ice and water dispenser capable of dispensing both ice and chilled water, while in other embodiments, dispenser 26 may be an ice only dispenser for dispensing only cubed and/or crushed ice. In still other embodiments, dispenser 26 may additionally dispense hot water, sparkling water, coffee, beverages, or other liquids, and may have variable and/or fast dispense capabilities. In some instances, ice and water may be dispensed from the same location, while in other instances separate locations may be provided in the dispenser for dispensing ice and water. In addition, while dispenser 26 is illustrated as being mounted on the cabinet 12, and thus separate from any door, in other embodiments dispenser 26 may be door-mounted, and as such, may be disposed on a fresh food or freezer door. In still other embodiments, dispenser 26 may be disposed within a compartment of a refrigerator, and accessible only after opening a door.

Figure 2:
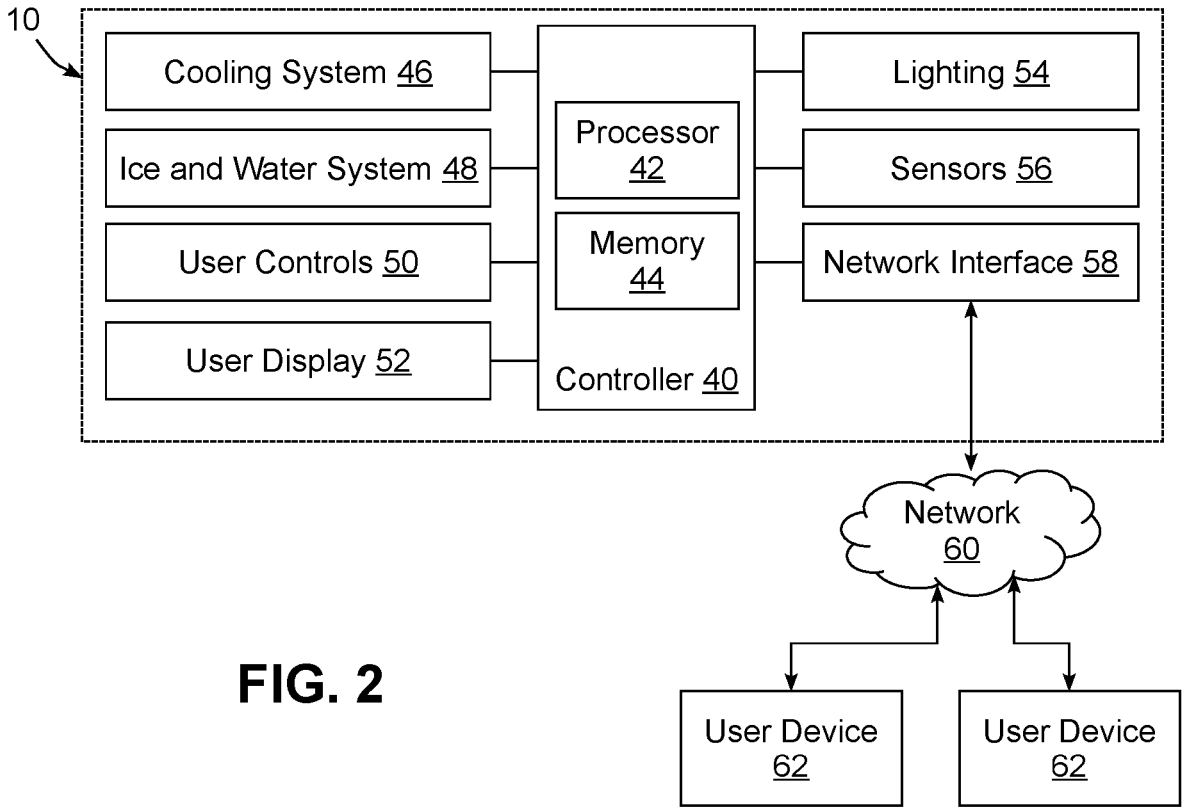
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others. User controls and/or user displays 50, 52 may be disposed, for example, on one or more control panels disposed in the interior and/or on doors and/or other external surfaces of the refrigerator. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. Sensors 56 may also include additional types of sensors such as door switches, switches that sense when a portion of an ice dispenser has been removed, and other status sensors, as will become more apparent below.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media.

In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Ice Dispensing System with Multiple Ice Movers

In the embodiments discussed hereinafter, a refrigerator may include an ice dispensing system incorporating multiple ice movers that are arranged adjacent to one another and operable to move ice in opposite directions. An ice mover, in this regard, may be considered to include any structure capable of moving ice within a container, e.g., a storage bin or other repository for ice. In the illustrated embodiments, for example, an ice mover may be implemented as an auger capable of moving ice generally along a rotational axis thereof in response to rotation of the auger. An auger may be constructed of various materials, e.g., various metals or plastics, and may incorporate various geometries, e.g., using a helical blade, using a helical rod, using multiple fingers or paddles extending from a central axis, etc. An ice mover may also be implemented as a conveyor in some embodiments, e.g., employing a belt or chain driven by one or more pulleys or gears, or one or more paddles. Other implementations of an ice mover will be appreciated by those of ordinary skill having the benefit of the instant disclosure.

Through the use of multiple adjacent ice movers, a number of advantages may be realized. For example, as compared to single ice mover configurations, multiple ice movers may enable a lower profile design (e.g., a reduced height relative to a width, where height and width may be measured in directions that are transverse to a direction of movement by an ice mover) to be used in a storage bin or other container, as multiple adjacent ice movers having relatively smaller cross-sectional profiles may be used to span a width of the storage bin or other container in lieu of a single ice mover having a larger cross-sectional profile.

Furthermore, multiple ice movers may be operated in different directions to address ice clumping issues that are frequently encountered in many ice dispensing systems. Conventional single ice mover configurations, in particular, are generally only used when ice is being dispensed, and move the ice in a single direction towards a dispenser outlet. When no ice is dispensed for an extended period of time, however, the ice may have a tendency to clump and freeze together, as well as get stale. Multiple ice movers, in contrast, may be used to circulate the ice within a storage bin or other container.

Figure 3:
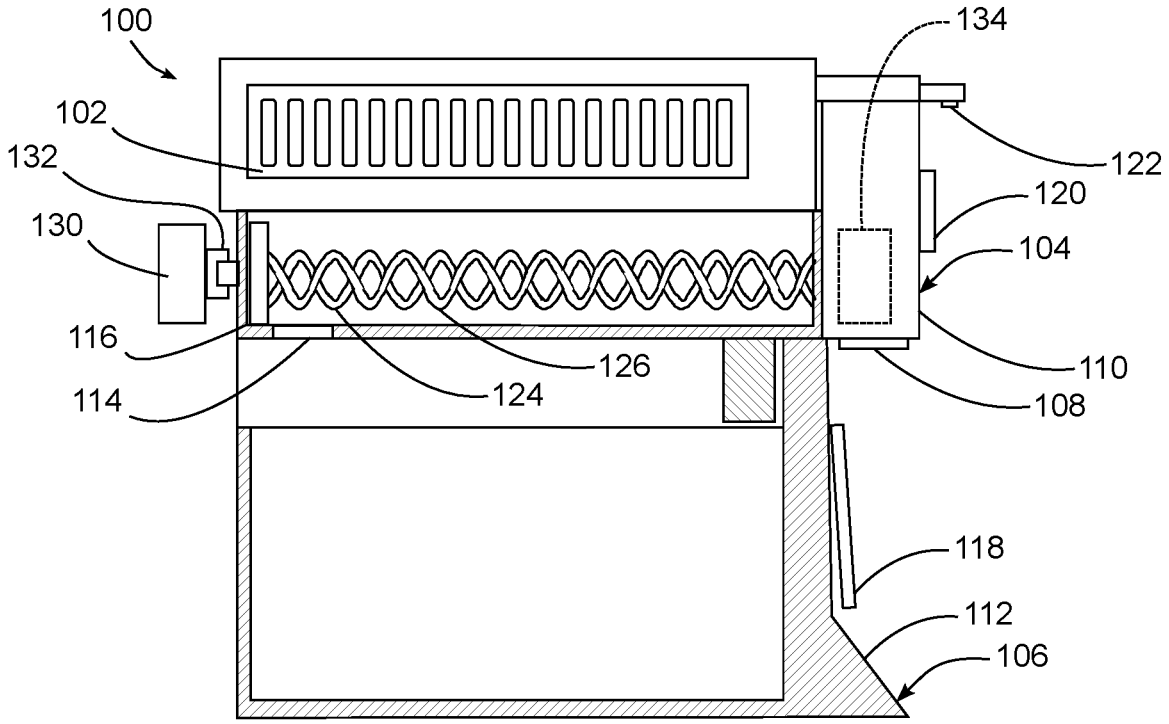
FIG. 3 is a side elevational view of an ice and water system utilizing multiple ice movers consistent with some embodiments of the invention, with portions thereof cut away.
Figure 4:
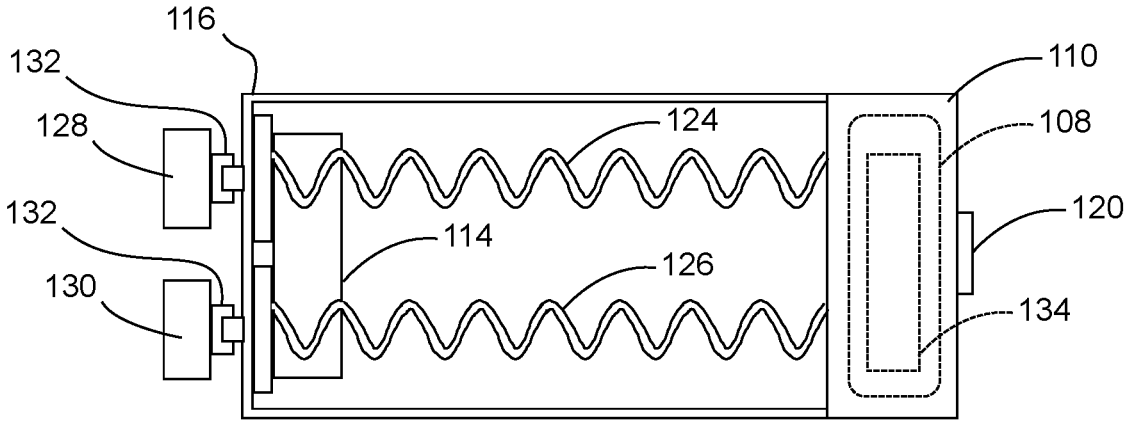
FIG. 4 is a top plan view of the upper storage bin from the ice and water system of FIG. 3.

FIGS. 3 and 4, for example, illustrate an example implementation of an ice and water system 100 incorporating an ice dispensing system consistent with the invention, and usable, for example, to implement dispenser 26 of refrigerator 10 illustrated in FIG. 1. System 100, in particular, includes an ice maker 102 positioned above a pair of tandem ice storage bins, referred to herein as upper and lower storage bins 104, 106. System 100, for example, may be implemented in a similar manner to that illustrated in U.S. Ser. No. 15/835,953 and U.S. Ser. No. 15/836,035, filed on Dec. 8, 2017 by Eric Scalf, and assigned to the same assignee as the present invention, which applications are incorporated by reference herein.

Each of storage bins 104, 106 is removable, e.g., via sliding outwardly from the front of a refrigerator, and upper storage bin 104 includes an ice dispenser outlet 108 disposed at a first end 110 thereof and positioned above a dispenser recess 112 defined by the front of lower storage bin 106. An opening 114 is also defined in a bottom wall of upper storage bin 104 proximate a second end 116 thereof. Ice produced by ice maker 102 falls into upper storage bin 104, and when moved towards first end 110 falls through ice dispenser outlet 108, and when moved towards second end 116 falls through opening 114 and into lower storage bin 106.

Dispensing of ice may be controlled, for example, using an ice dispenser control 118, e.g., a control paddle, button or other suitable control disposed within dispenser recess 112. Water dispensing, in turn, may be controlled by a water dispenser control 120 positioned below a water outlet 122. It will be appreciated that while ice dispenser outlet 108 and water outlet 122 are disposed at different locations in ice and water system 100, in other embodiments, ice and water dispensing may be performed from generally the same location, e.g., within dispenser recess 112. In addition, while controls 118, 120 are disposed respectively on front faces of lower storage bin 106 and upper storage bin 104, in other embodiments, ice and/or water controls may be disposed on either of storage bins 104, 106 or on other structures in a refrigerator, e.g., on a fixed and non-removable surface of a cabinet or case, on a compartment door, etc. Moreover, in some embodiments, no water dispensing capability may be supported. In addition, as will become more apparent below, embodiments consistent with the invention need not employ multiple storage bins. As such, it will be appreciated that the invention is not limited to the particular ice and water system illustrated in FIG. 3.

With additional reference to FIG. 4, upper storage bin 104 also includes multiple ice movers, here first and second ice augers 124, 126 disposed adjacent one another and at generally the same elevation, or put another way, in a side-by-side configuration whereby the rotational axes thereof are generally parallel to one another. Each ice auger 124, 126 is implemented in this embodiment using a metal rod formed into a helical shape, although other ice auger designs may be used in other embodiments.

In addition, in this embodiment, each ice auger 124, 126 is independently controlled via separate ice mover drives 128, 130, e.g., electric motors, and by virtue of the removability of upper storage bin 104, each ice auger 124, 126 is desirably mechanically coupled to its respective ice mover drive 128, 130 through a detachable coupling 132 (e.g., a keyed coupling that interlocks each ice auger 124, 126 with the respective ice mover drive 128, 130 when upper storage bin 104 is pushed rearwardly into an operative position in ice and water system 100). In embodiments where ice movers are disposed in non-removable containers, however, non-detachable couplings may be utilized.

Ice and water system 100 may also include an ice crusher assembly 134 that may be selectively activated during a dispensing operation to crush ice prior to dispensing through ice dispenser outlet 108. When cubed ice is desired, ice crusher assembly 134 may be deactivated during the dispensing operation. A wide variety of known ice crusher designs may be used in different embodiments, as will be appreciated by those of ordinary skill having the benefit of the instant disclosure.

In the illustrated embodiment, ice and water system 100 supports a number of different ice-related operations. First, an ice dispensing operation may be supported, whereby ice within upper storage bin 104 is conveyed in a first direction toward first end 110 for dispensing from ice dispenser outlet 108 (with or without concurrent activation of ice crusher assembly 134). The ice dispensing operation may be actuated, for example, in response to user input via dispenser control 118, e.g., when a glass or cup is pressed against dispenser control 118. Moreover, ice may be conveyed toward first end 110 using both ice augers 124, 126 in some embodiments, while in other embodiments only one of ice augers 124, 126 may be used to perform an ice dispensing operation, with the other ice auger idled during the operation.

Second, an ice transfer operation may be supported, whereby ice within upper storage bin 104 is conveyed in a second direction toward second end 116 for transfer into lower storage bin 106 through opening 114. The ice transfer operation may be actuated, for example, in response to detecting that the upper storage bin 102 is full, e.g., using a level sensor such as a paddle or optical sensor disposed proximate upper storage bin 102. Moreover, ice may be conveyed toward second end 116 using both ice augers 124, 126 in some embodiments, while in other embodiments only one of ice augers 124, 126 may be used to perform an ice transfer operation, with the other ice auger idled during the operation. The ice transfer operation may be used in some instances to clear space in the upper storage bin prior to the completion of an ice making cycle with ice maker 102, such that when the ice making cycle is complete, the newly-created ice may be dropped into the upper storage bin.

Third, an ice circulation operation may be supported, whereby ice within upper storage bin 104 is circulated to break apart clumps of ice, as well as to mix the ice and prevent ice from remaining in the upper storage bin and becoming stale prior to dispensing. In addition, circulating the ice may spread the ice out within the upper storage bin to fit more ice in the upper storage bin before the ice maker shuts off. During an ice circulation operation, both ice augers are operated concurrently during at least a portion of the operation, and generally in opposite directions, and the direction of operation of each auger may be reversed one or more times during the ice circulation operation to effectively "stir" the ice within the upper storage bin without conveying the ice to either the dispenser outlet 108 or the opening 114 to the lower storage bin. It will be appreciated that in some embodiments a door or other closure may also be used over either dispenser outlet 108 or opening 114 to restrict the flow of ice therethrough except during an ice dispensing operation (whereby dispenser outlet 108 would be opened) or an ice transfer operation (whereby opening 114 would be opened). An ice circulation operation may be actuated, for example, on a periodic basis, during periods of non-use, in response to sensed data (e.g., humidity and/or temperature variations), in response to manual input, or in other suitable instances.

An ice circulation operation consistent with the invention may include operation of both ice augers 124, 126 during at least a portion of the ice circulation operation. In some instances, each ice auger may operate in a single direction, e.g., with ice auger 124 operating to push ice in a forward direction (towards first end 110) and ice auger 126 operating to push ice in a rearward direction (towards second end 116), or vice versa. In addition, in some instances, one or both the ice augers 124, 126 may be reversed one or more times during an ice circulation operation. Furthermore, in some instances, both ice augers 124, 126 may operate concurrently with one another for at least a portion of the operation. In some instances, ice augers 124, 126 may be operated sequentially, or one or both of ice augers 124, 126 may be idle while the other ice auger is operating. Furthermore, in some instances, one or both of ice auger drives 128, 130 may be capable of driving an ice auger at a variable speed, such that ice augers 124, 126 need not operate at the same speed.

Figure 5:
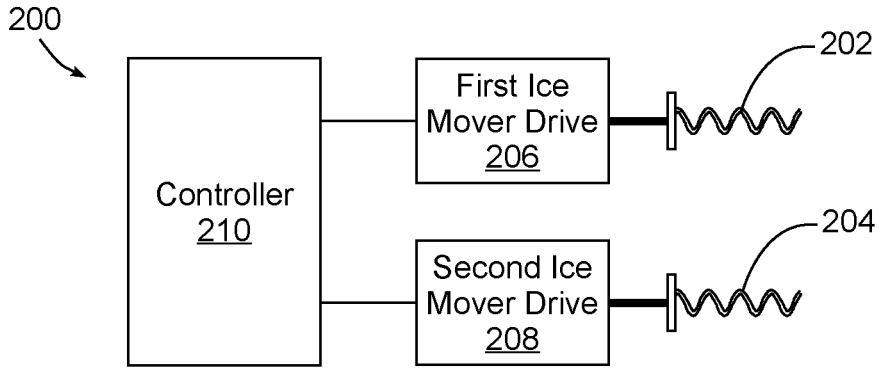
FIG. 5 is a functional block diagram of an example implementation of an ice dispensing system incorporating multiple ice movers consistent with the invention, and employing multiple ice mover drives.
Figure 6:
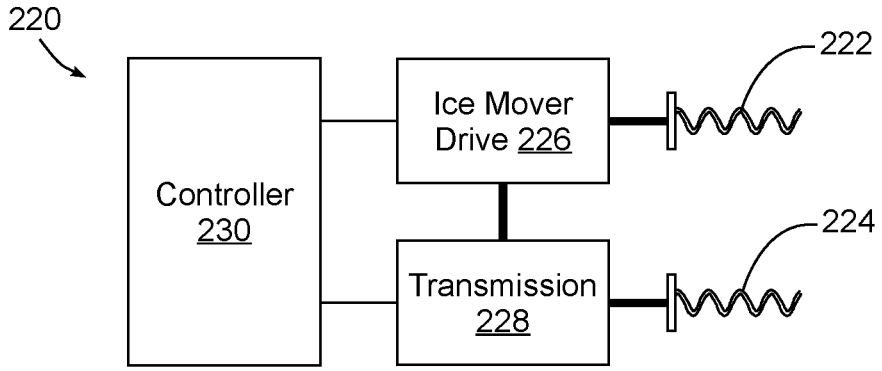
FIG. 6 is a functional block diagram of another example implementation of an ice dispensing system incorporating multiple ice movers consistent with the invention, and employing a single ice mover drive coupled to an ice mover using a transmission.
Figure 7:
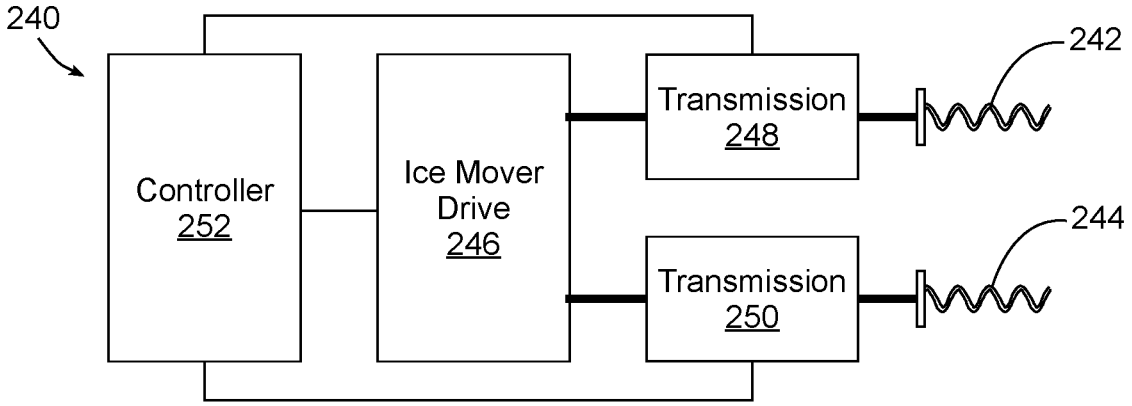
FIG. 7 is a functional block diagram of another example implementation of an ice dispensing system incorporating multiple ice movers consistent with the invention, and employing a single ice mover drive coupled to multiple ice movers using multiple transmissions.

Now turning to FIGS. 5-7, multiple ice movers may be driven in a variety of different manners in different embodiments. FIG. 5, for example, illustrates an example ice dispensing system 200 including first and second ice movers 202, 204 having independent ice mover drives 206, 208 controlled by a controller 210. Drives 206, 208 may be electric motors in some embodiments, while in other embodiments other types of drives may be used, e.g., pneumatic, hydraulic, magnetic, etc. One or both of drives 206, 208 may be reversible in some embodiments, while in other embodiments each drive 206, 208 may only operate in a single direction. Moreover, while in some embodiments, each drive 206, 208 may be a single speed drive, in other embodiments, one or both of drives 206, 208 may be variable speed.

FIG. 6 illustrates another example ice dispensing system 220 including first and second ice movers 222, 224, but including a single ice mover drive 226 coupled to one or both of ice movers 222, 224 through a transmission 228. In ice dispensing system 220, for example, ice mover drive 226 directly drives ice mover 222, while transmission 228 is coupled between ice mover drive 226 and ice mover 224. A controller 230 is coupled to both ice mover drive 226 and transmission 228, and transmission 228 may be controllable by controller 230 to vary the operation of ice mover 224 relative to ice mover 222. In some embodiments, for example, transmission 228 may be used to selectively decouple ice mover 224 from ice mover drive 226, such that in one mode, ice mover driver 226 drives both ice movers 222, 224, while in another mode ice mover driver 226 drives only ice mover 222, while ice mover 224 remains idle. In some embodiments, for example, transmission 228 may be implemented as a selectively-actuated clutch.

In other embodiments, transmission 228 may be used to selectively reverse the operation of ice mover 224, such that in one mode, ice mover driver 226 drives ice mover 224 in one direction, while in another mode ice mover driver 226 drives ice mover 224 in the opposite direction. In still other embodiments, transmission 228 may be configurable to switch between three or more modes, e.g., to reverse and/or idle ice mover 224 and/or change the speed of ice mover 224.

Moreover, as illustrated by ice dispensing system 240 of FIG. 7, rather than coupling one ice mover to an ice mover drive through a transmission, a pair of ice movers 242, 244 may each be coupled to an ice mover driver 246 through separate transmissions 248, 250, with each of ice mover driver 246 and transmissions 248, 250 controlled by a controller 252.

A transmission consistent with the invention may include any number of mechanical and/or electromechanical arrangements suitable for coupling a prime mover (e.g., an ice mover drive) to one or more ice movers, e.g., employing gears, belts, pulleys, etc.

In operation, an ice dispensing system may be configured to perform at least a dispensing operation and an ice circulation operation. In one example embodiment, two unidirectional augers may be provided, with one capable of being driven in a forward direction to push ice towards a dispenser port, and with the other capable of being driven in a reverse direction to push ice in the opposite direction. During an ice dispensing operation, only the forward operating auger may be activated, with the reverse operating auger idle, while during an ice circulation operation, both augers may be activated to circulate the ice. Moreover, where a tandem ice storage bin implementation such as shown in FIG. 3 is used, an ice transfer operation may also be supported, whereby only the reverse operating auger may be activated, with the forward operating auger remaining idle.

In another example embodiment, two bidirectional augers may be provided, such that during an ice dispensing operation, one or both augers may be driven in a forward direction to push ice towards a dispenser port. During an ice circulation operation, the augers may be driven in opposite directions to circulate the ice. As noted previously, the directions of the augers may be reversed at different points in an ice circulation operation in some embodiments, and in still other embodiments, individual augers may vary in speed, direction, activation state, etc., at different points in an ice circulation operation. Moreover, where a tandem ice storage bin implementation such as shown in FIG. 3 is used, an ice transfer operation may also be supported, whereby one or both augers may be driven in the reverse direction to push ice towards the opening to the lower storage bin.

It will be appreciated that more than two ice movers may be used in some embodiments, and moreover, that different types and/or configurations of ice movers may be used together in some embodiments. For example, where two augers are used in an ice dispensing system, the augers may be helically wound in opposite directions such that, for example, the forward direction for one auger may correspond to clockwise rotation of the auger, while the forward direction for the other auger may correspond to counterclockwise rotation of the auger.

Other variations will be apparent by those of ordinary skill having the benefit of the instant disclosure. For example, multiple ice movers may be used in other types of ice dispensing systems, including, for example, ice dispensing systems with only a single ice storage bin, or within other containers, including non-removable containers. It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A refrigerator comprising:

a cabinet including one or more food compartments and one or more doors closing the one or more food compartments;

an ice dispensing system disposed in the cabinet to produce ice, the ice dispensing system including a storage bin configured to store and dispense ice produced by the ice dispensing system, the storage bin including first and second ends, a dispenser outlet proximate the first end to dispense ice to an ice dispenser opening, and first and second ice movers arranged adjacent to one another between the first and second ends, wherein the first ice mover is operable to move ice toward the first end of the storage bin, and wherein the second ice mover is operable to move ice toward the second end of the storage bin; and a controller coupled to the ice dispensing system and configured to operate the first ice mover to move ice toward the first end of the storage bin and out of the dispenser outlet during an ice dispensing operation, and configured to operate the second ice mover concurrently with operating the first ice mover to circulate ice in the storage bin during an ice circulation operation.

2. The refrigerator of claim 1, wherein the first and second ice movers are oriented at a substantially same elevation.

3. The refrigerator of claim 1, wherein the first and second ice movers are augers.

4. The refrigerator of claim 1, wherein the second ice mover is further operable to move ice toward the first end of the storage bin, and wherein the controller is configured to operate the second ice mover to move ice toward the first end of the storage bin concurrently with operating the first ice mover during the ice dispensing operation.

5. The refrigerator of claim 1, wherein the ice dispensing system includes first and second ice mover drives respectively coupled to the first and second ice movers.

6. The refrigerator of claim 5, wherein the controller is configured to operate the second ice mover drive in a first direction to operate the second ice mover to move ice toward the first end of the storage bin, and to operate the ice mover drive in a second direction to operate the second ice mover to move ice toward the second end of the storage bin.

7. The refrigerator of claim 5, wherein each of the first and second ice mover drives includes an electric motor.

8. The refrigerator of claim 1, wherein the ice dispensing system includes an ice mover drive and a transmission, wherein at least one of the first and second ice movers is coupled to the ice mover drive through the transmission.

9. The refrigerator of claim 8, wherein the transmission is configured to selectively decouple the at least one of the first and second ice movers from the ice mover drive.

10. The refrigerator of claim 8, wherein the transmission is configured to selectively reverse the at least one of the first and second ice movers.

11. The refrigerator of claim 8, wherein the ice mover drive includes an electric motor.

12. The refrigerator of claim 1, wherein the storage bin is a first storage bin, and wherein the ice dispensing system further comprises:

an ice maker disposed over the first storage bin and configured to produce ice and drop the ice into the first storage bin; and a second storage bin disposed below the first storage bin and configured to receive ice disposed in the first storage bin when the ice is moved toward the second end of the first storage bin.

13. The refrigerator of claim 12, wherein the first storage bin includes an opening on a bottom wall thereof proximate the second end of the first storage bin, the opening positioned such that ice moved toward the second end of the first storage bin falls through the opening and into the second storage bin.

14. A refrigerator comprising:

a cabinet including one or more food compartments and one or more doors closing the one or more food compartments;

an ice dispensing system disposed in the cabinet to produce ice, the ice dispensing system including upper and lower storage bins configured to store and dispense ice produced by the ice dispensing system, the upper storage bin including first and second ends, a dispenser outlet proximate the first end to dispense ice to an ice dispenser opening, an opening proximate the second end to convey ice to the lower storage bin, first and second ice movers arranged adjacent to one another between the first and second ends, and first and second ice mover drives respectively coupled to the first and second ice movers, wherein the first ice mover drive is operable to drive the first ice mover to move ice toward the first end of the upper storage bin, and wherein the second ice mover drive is operable to drive the second ice mover to move ice toward the second end of the upper storage bin; and a controller coupled to the ice dispensing system and configured to operate the first ice mover drive to drive the first ice mover to move ice toward the first end of the upper storage bin and out of the dispenser outlet during an ice dispensing operation, configured to operate the second ice mover drive to drive the second ice mover to move ice toward the second end of the upper storage bin and through the opening during an ice transfer operation, and configured to operate the first and second ice movers concurrently with one another using the first and second ice mover drives to circulate ice in the upper storage bin during an ice circulation operation.

* * * * *